US006595475B2

(12) United States Patent
Svabek et al.

(10) Patent No.: US 6,595,475 B2
(45) Date of Patent: Jul. 22, 2003

(54) DISPENSER PLATFORM

(75) Inventors: John J. Svabek, Bedford Park, IL (US); Alex J. Kaminecki, Chicago, IL (US)

(73) Assignee: Archer Wire International Corporation, Bedford Park, IL (US)

( * ) Notice: Subject to any disclaimer, the term of this patent is extended or adjusted under 35 U.S.C. 154(b) by 0 days.

(21) Appl. No.: 10/007,592

(22) Filed: Dec. 5, 2001

(65) Prior Publication Data

US 2003/0102413 A1 Jun. 5, 2003

(51) Int. Cl.[7] ..... A47G 23/02

(52) U.S. Cl. ..... 248/150; 248/153; 211/195; 221/282

(58) Field of Search ..... 248/153, 151, 248/150, 166; 211/195; 126/9 R; 221/282, 285; D6/462, 429

(56) References Cited

U.S. PATENT DOCUMENTS 1,235,358 A * 7/1917 Mayfield ..... 211/74
1,689,091 A * 10/1928 Watt ..... 248/151
2,122,275 A * 6/1938 Bitney ..... 108/25
2,697,574 A * 12/1954 Bricker ..... 248/149
3,306,281 A * 2/1967 Hoebel ..... 126/25 R
3,603,541 A * 9/1971 Sturm et al. ..... 48/50
3,848,748 A * 11/1974 Ceccarelli ..... 211/181.1
3,905,286 A * 9/1975 Le Grady ..... 126/25 R
4,943,029 A * 7/1990 Szuster ..... 211/181.1
4,971,277 A * 11/1990 Tedham et al. ..... 248/153
5,097,971 A * 3/1992 Norris et al. ..... 211/126.6
5,103,799 A * 4/1992 Atanasio ..... 126/25 A
5,713,546 A 2/1998 Auspos
5,810,299 A * 9/1998 Poulos ..... 211/195
6,095,372 A 8/2000 Dorsey et al.

* cited by examiner

*Primary Examiner*—Korie Chan
(74) *Attorney, Agent, or Firm*—Joseph P. Krause; Vedder, Price, Kaufman & Kammholz

(57) ABSTRACT

A support stand for a beverage container is formed from rigid wires and includes a substantially planar support platform supported by two legs that are removably interengaged with and locked with locking loops formed as part of the wire support members.

10 Claims, 6 Drawing Sheets

DISPENSER PLATFORM

BACKGROUND OF THE INVENTION

Boxed-beverage containers, such as boxed wine coolers depicted in FIG. 1, offer consumers a convenient form of packaging for beverages. Relatively heavy-weight cardboard provides a substantially rigid protective container for a liquid-filled bladder from which beverages can be dispensed through a plastic valve. Such boxed wine packages are easily packaged for shipment, display, sale and distribution. In use, however, dispensing wine from a wine box cooler can be problematic. Dispensing liquid from a boxed beverage container requires the user to position the boxed liquid container so that the valve projects over the edge of a table top or other flat surface so that a glass to be filled can be positioned under the valve opening. In other words, boxed liquid dispensers, be they wine coolers or liquid laundry detergent dispensers do not lend themselves to use away from the edge of a horizontal surface; they must be used by hanging them or positioning them such that the valve projects over the edge of a tabletop or other horizontal surface. A stand or platform by which a boxed liquids can be more conveniently dispensed would be an improvement over the prior art.

SUMMARY OF THE INVENTION

There is provided a folding/foldable support stand and platform formed from rigid wire which is sized to accept boxed liquid containers and which allows such containers to be used away from edges of a horizontal surface. The platform supports allows glasses and other containers to be filled from the spigot of a boxed beverage container without having to place the boxed container over the edge of a table surface. In the preferred embodiment, the support platform is formed to include wire locking loops on a platform portion and complementary inter-engaging loops on support legs that are also formed from rigid wire. The wire legs are readily locked into an upright position by inter-engaging loops on the legs and platform. By disengaging the locking loops the legs can be folded below the platform.

DETAILED DESCRIPTION OF A PREFERRED EMBODIMENT

Figure 1:
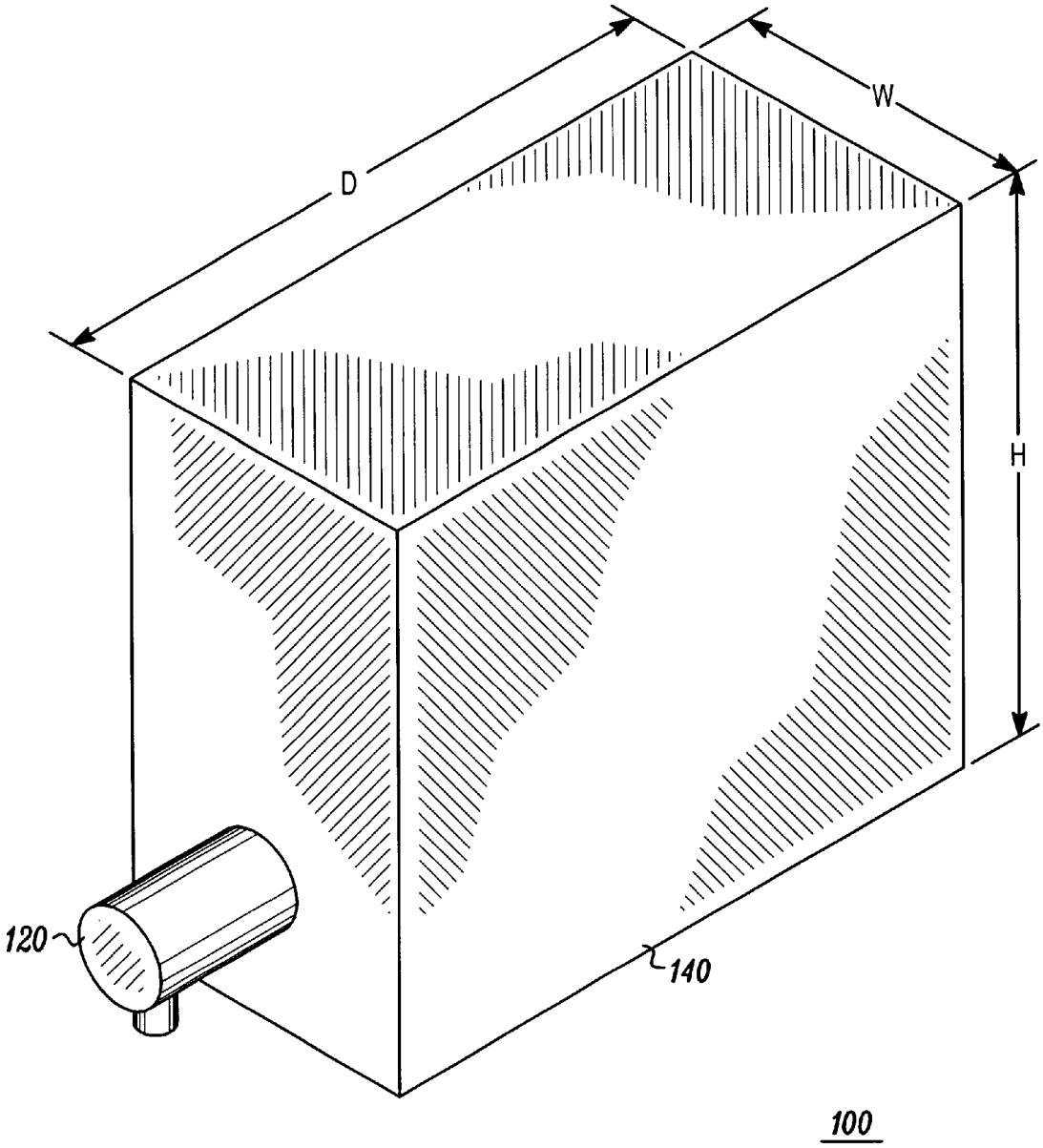
FIG. 1 is a perspective view of a beverage container box or "wine box."

FIG. 1 shows a perspective view of an exemplary beverage container box (hereafter a "wine box" or "container") 100. The wine box 100 is generally rectangular in shape, having a spigot 120 located at or near the bottom 140 of the container 100 and from which a liquid is dispensed from a bladder (not shown) within the container 100.

The container 100 has a width w, depth d and a height h defining a rectangular footprint of the container. A stand for the container 100 is preferably sized to accept the footprint of the container 100, exerting at least a modicum of pressure on the exterior surfaces of the container 100 so as to hold the container 100 in place in the stand.

Figure 2:
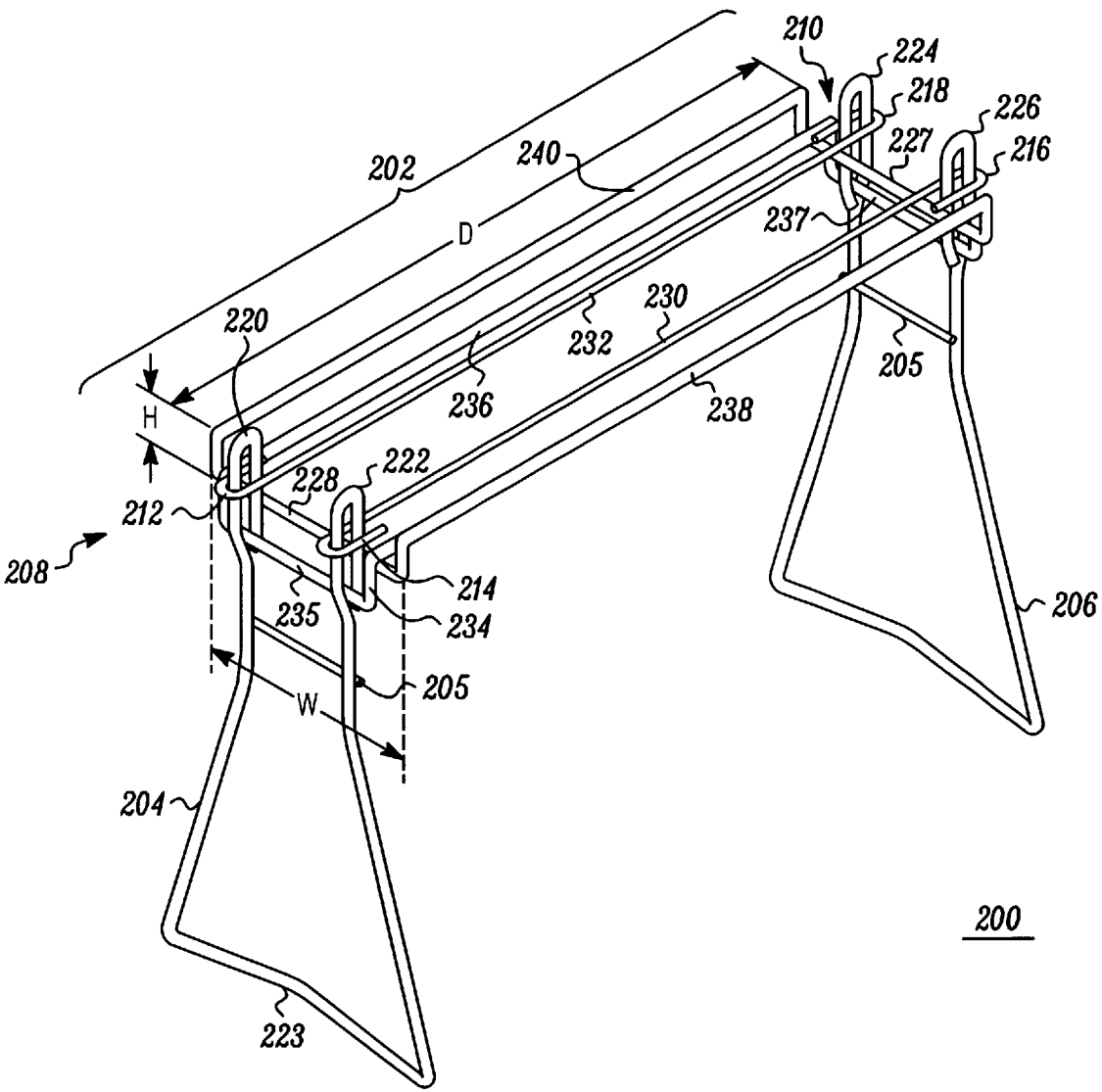
FIG. 2 is a perspective view of a preferred embodiment of a beverage container support stand.

FIG. 2 shows a perspective view of the preferred embodiment of a foldable wire support stand 200 for a wine box 100. While the embodiment of the support stand 200 depicted in FIG. 2, is intended for use with beverage container boxes such as the one shown in FIG. 1, the support stand 200 also can be used to support other objects such as, but not limited to, liquid detergent containers.

The support stand 200 shown in FIG. 2 has three major components: a support platform 202 and two support legs 204 and 206. In the preferred embodiment, the support stand and platform components are all constructed from rigid wire. Such wire can be of aluminum, stainless steel, mild steel, spring steel or any other appropriate material subject to the requirement that the wire be sufficient rigid so as to retain its shape when subjected to the load imposed by the container that the wire is required to support. The constituent wire in the preferred embodiment has a diameter of approximately 3–5 millimeters but wire of any diameter and material that maintains it's shape under moderate loads could also be used.

The preferred embodiment of the support platform 202 is a wine box stand and is maintained at an elevated height above a table or other horizontal surface when the first and second wire-formed legs 204 and 206 are unfolded from their storage position (depicted in FIG. 6) and locked upright by way of inter-engaging locking loops on the legs 204, 206 and on the platform 202.

Even though it is constructed of wire, the platform 202 can be thought of as providing a planar surface in that each of the wire supports lie in substantially one spatial plane. The constituent wire support members 230, 232, 234 and 236 that are substantially co-planar extend parallel to each other. Alternate and equivalent embodiments include wire support members that are not parallel and which lie in different planes of space. In the preferred embodiment, the wire support members are substantially coplanar to each other, however alternate embodiments would include wire support members that lie in other, albeit parallel planes.

The ends of the wire members 230, 232, 234 and 236 are fixedly attached at their respective ends to cross members 228 and 227 by way of a tack weld. A box or other container resting on the support platform 202 is held in place on top of the platform 202 by wire side walls 238 and 240 and by the vertically-oriented leg locking loops 220, 222, 224 and 226 that comprise the legs 204 and 206 that support the platform 202. The leg locking loops that comprise the legs 204 and 206 engage orthogonal platform locking loops 212, 214, 216 and 218 that are formed as part of the support platform 202.

Two of the wires 230 and 232 that comprise the support platform 202 are formed to have at their ends, open arcuate sections (open, U-shaped bends). When the open ends are fixedly attached to cross members 228 and 227, the open bends at the ends of the wires 230 and 232 form planar platform locking loops which are identified by reference numerals 212, 214, 216 and 218.

As can be seen in FIG. 2, the wire cross members 228 and 227 are orthogonal to the wire members 230, 232, 234 and 236 thereby forming a substantially rectangular support platform 202.

In the preferred embodiment, the planar platform locking loops 212, 214, 216 and 218 are substantially co-planar with the plane in which the wires 230, 232, 234 and 236 lie in. Alternate and equivalent embodiments include locking loops 212, 214, 216 and 218 that are not co-planar with the wires 230, 232, 234 and 236 by extending the wires and/or the length of the locking loops and bending one or both to lie in a plane other than that which the platform 202 lies in.

The platform locking loops 212, 214, 216 and 218 coupled to the platform 202 are formed to have opening sizes (major lengths and widths) that will accept similarly-sized mating and inter-engaging and orthogonal leg locking loops 220 and 222 formed by bending the wire 223 from which the legs 204 and 206 are formed. In particular, the first leg 204 and its leg locking loops 220 and 222 are sized (factoring in the diameter of the wire) to extend upward from the locking loops of the platform 212 and 214 by a distance or height H which is substantially equal to the height of the sides of the platform 238 and 240 formed by upturning the wire that forms the horizontal cross members 227 and 228.

The first leg locking loops 220 and 222 also extend downwardly to encircle and enclose a horizontal wire support member 235. Like the platform locking loops of the support platform 202, the leg locking loops 220 and 222 of the first leg are formed by bending the wire from which the leg member is formed. It can be readily seen in FIG. 2 that the platform locking loops 212, 214, 216 and 218 of the support platform 202 are orthogonal to and removably inter-engage with the leg locking loops 220 and 222 of the leg by virtue of the sizing of the leg and platform locking loops. When the leg locking loops 220 and 222 are inserted into the openings of their complementary support platform 202 locking loops 212 and 214, the leg 204 is firmly locked in place.

The second leg 206 also is formed to have leg locking loops 224 and 226 that extend upward, interengage with and that with are orthogonal to the platform locking loops 218 and 216 formed at the second end 210 of the support platform 202. The leg locking loops 224 and 226 of the second leg 206 similarly extend upward in the plane formed by the horizontal support wires by a distance equal to H and extend downward over and enclosing the horizontal wire support member 237.

The first leg 204 and the second leg 206 are strengthened by means of a reinforcing horizontal member 205. The reinforcement member 205 maintains the spacing between the locking loops of the respective leg mechanisms 204 and 206.

The spacing between the leg locking loops and the spacing between the upturned side walls is selected so as to allow the base of the box depicted in FIG. 1 to just fit inside the side walls and leg locking loops. The spacing between the upturned side walls is substantially equal to the width W minus the diameter of the wire of which the side wall wires 238, 240 is made. Accordingly, in order to mildly compress a wine box, the width W and the wire diameter should be chosen to be slightly less than the width of the wine box. Similarly, the distance from one pair of leg locking loops to the second pair of leg locking loops should be just less than the depth of a wine box and calculated by subtracting the wire diameter from the depth D.

Friction between the box and the side walls and leg locking loops that is created in response to compressive forces exerted on the box by the rigid wire acts to secure the box within the side walls and the leg locking loops. The dimensions of W and D are chosen to accommodate industry-standard beverage containers, however, the dimensions of the platform are a design choice. In other words, the distance, D, between the inside of these leg locking loops 220, 222 and 224, 226 is substantially equal to the depth of a box or package to be supported on or by the support platform 202. Similarly, the support platform 202 has a width, W, between the upturned sides 238 and 240 sufficient to allow a carton or other package to be supported between the upturned sides.

The stand 200 can be readily assembled by inserting the leg locking loops 220, 222, 224, and 226 into the complementary platform locking loops 212, 214, 216 and 218. Disassembly is quite simple. When the leg locking loops 220, 222 and 224, 226 are pushed out of the orthogonal platform locking loops 212, 214, 216 and 218, the legs 204 and 206 are able to freely to rotate about the horizontal wire support members 235 and 237, around which the leg locking loops 220, 222 and 224, 226 are bent so as to retain the legs with the platform 202 but allow the legs 204 and 206 to freely rotate and fold or position under the bottom of the platform 202 for storage. When the stand 200 is not in use, it can be more compactly stored by folding the legs 204 and 206 under the platform 202 by the disengagement of the leg and platform locking loops from each other.

Figure 3:
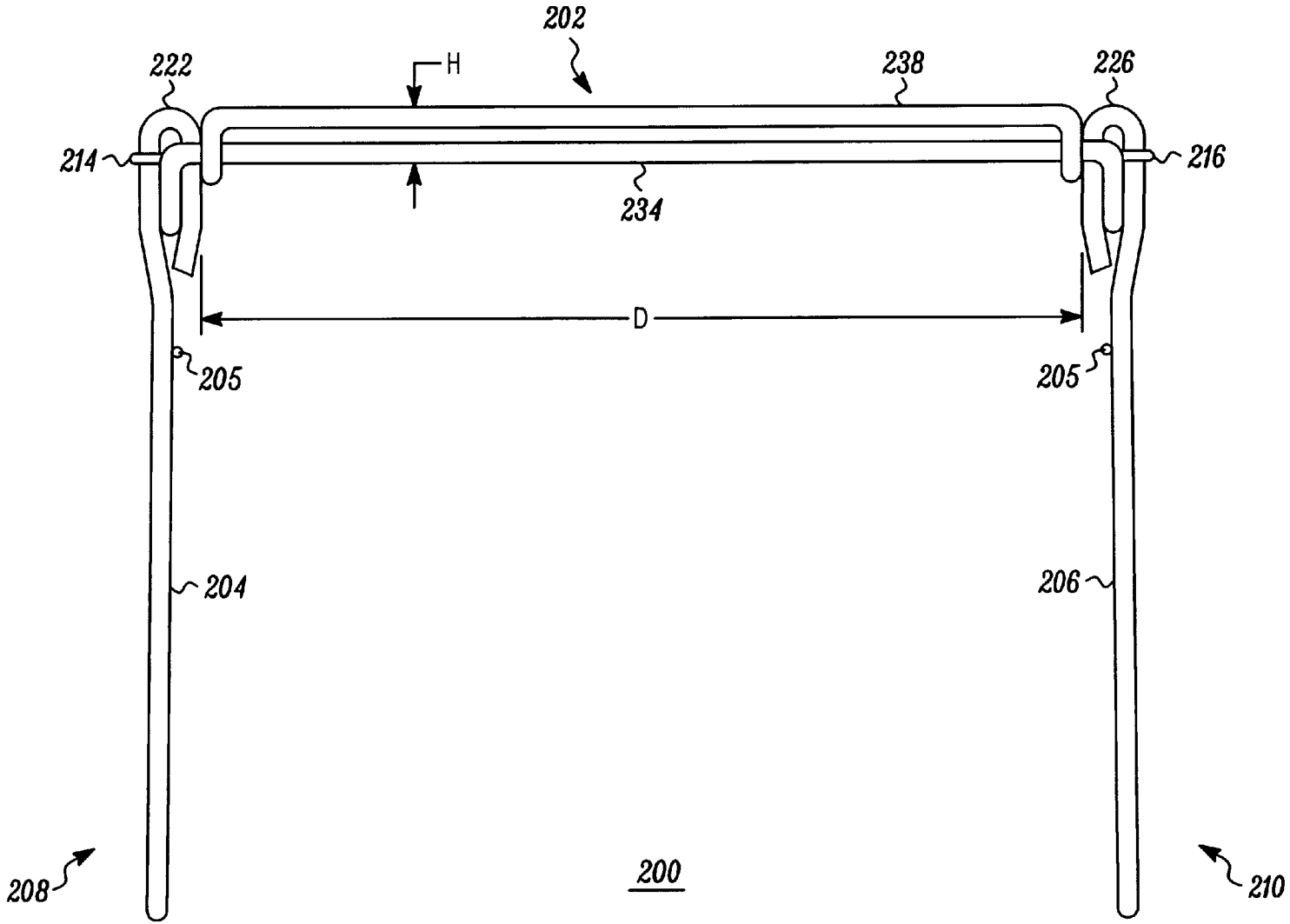
FIG. 3 is a right side elevation view of the support stand depicted in FIG. 1.

FIG. 3 shows a right side view of the foldable stand 200 and shows how the platform 202 has a first upturned side that is formed from a wire member 238. The height of the side is chosen to be H which is substantially equal to the height of the leg locking loops 222 and 226 when they are inter-engaged with (i.e., to extend through) the substantially coplanar platform locking loops 214 and 216 of the platform 202. Like the components of the platform 202, the legs 204 and 206 are formed by bending rigid steel wire and tack-welding reinforcing members that retain the shape of the legs.

Figure 4:
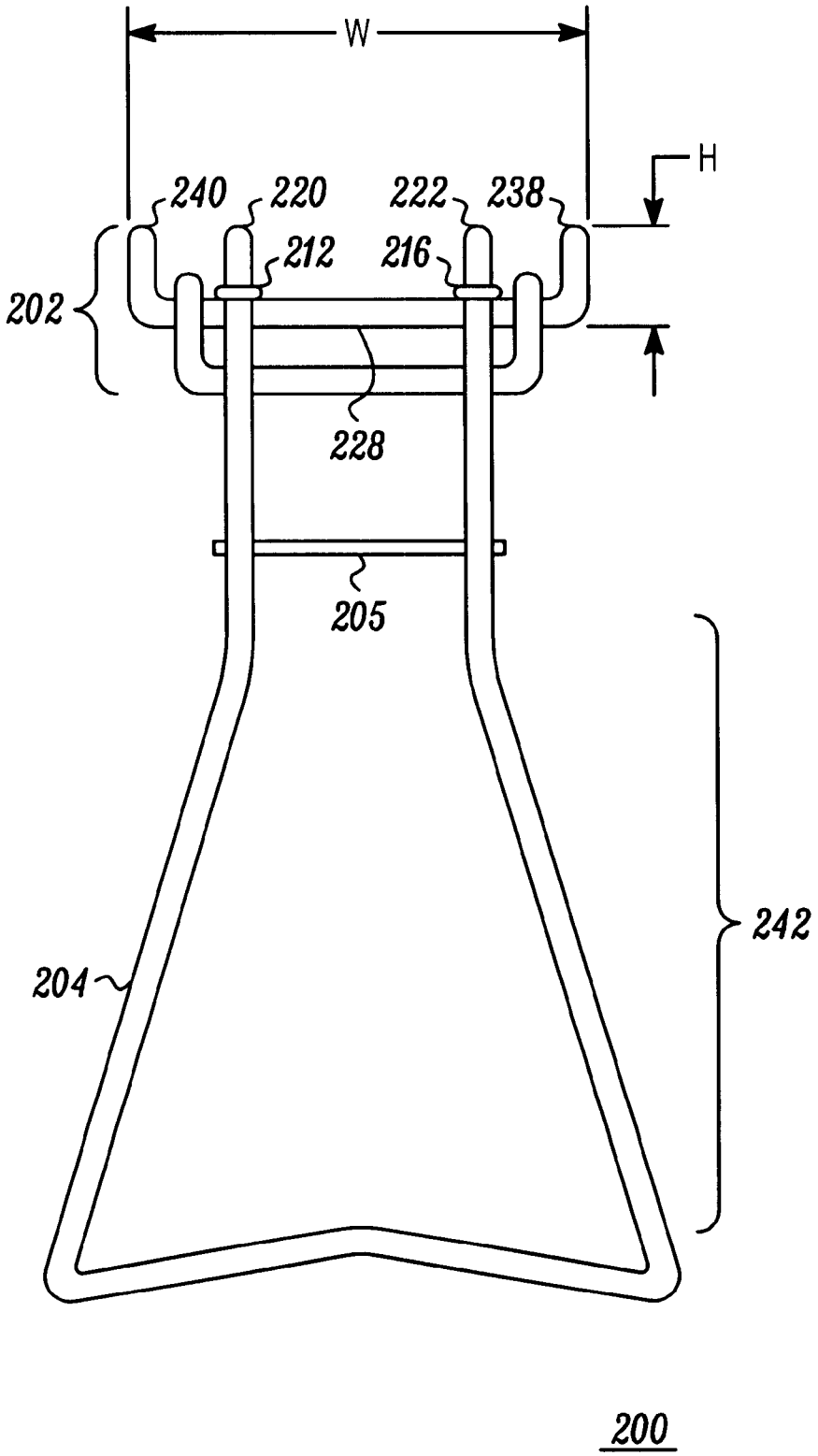
FIG. 4 is a front view of the support stand for a beverage container depicted in FIG. 1.

FIG. 4 shows an end view of the support platform for a platform 200 as depicted in FIG. 2. In FIG. 4, the structure of the first or front leg 204 (as well as the rear or second leg 206) is clearly shown. A single piece of rigid wire is bent to include a substantially trapezoidal section 242, the bottom or base of which being extended provides for increased lateral stability of the stand 200 for a beverage container. The leg locking loops 220 and 222 of the first leg are shown as extending above the substantially orthogonal platform locking loops 212 or 214 formed by the wire elements 232 and 230 depicted in FIG. 2. As shown in the end view, the substantially planar platform 202 has sides of a height H formed by upturning the wire cross member 228 and continuing the support wire from the front or first end 208 of FIG. 2 back to the rear or second end 210 of FIG. 2.

Figure 5:
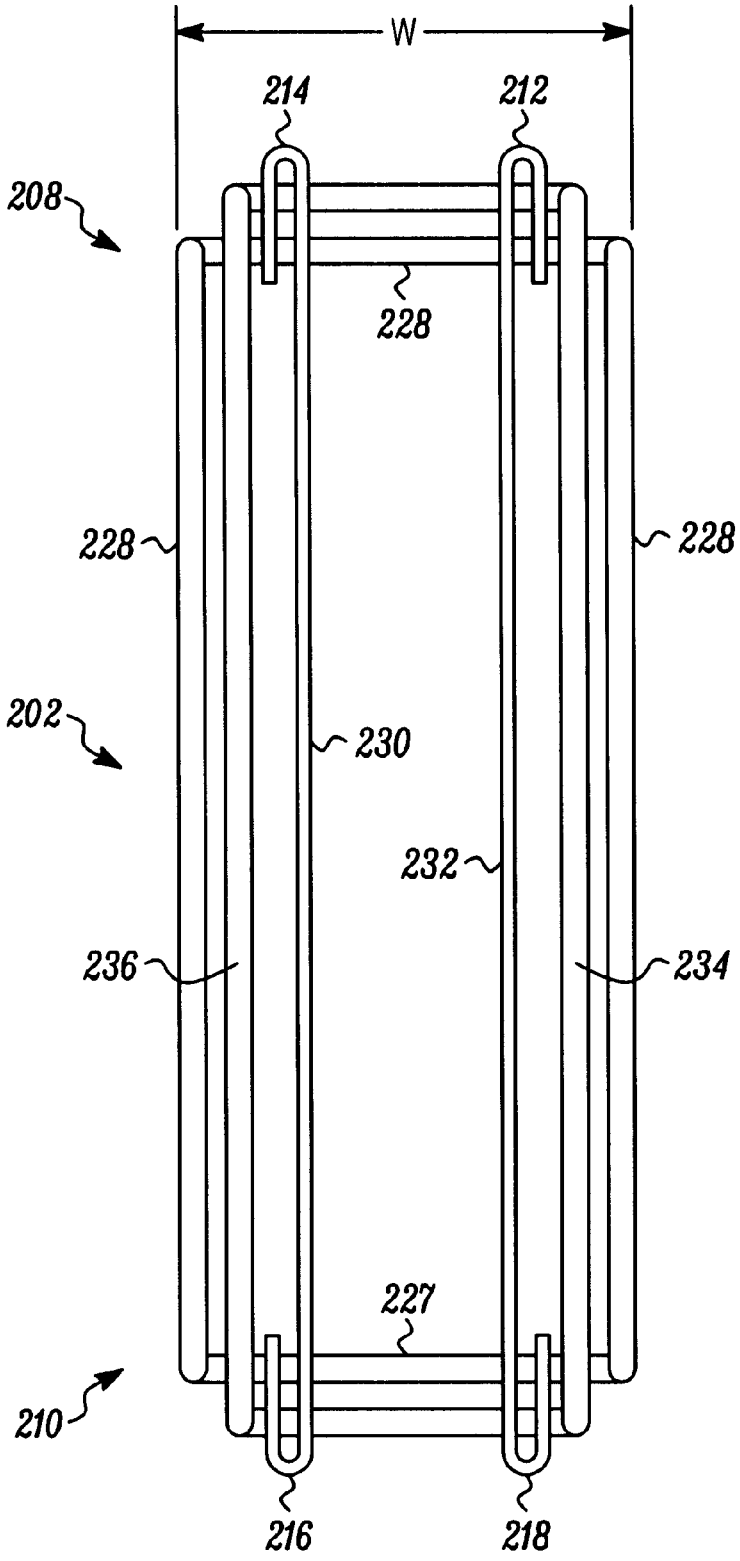
FIG. 5 is a top view of the support platform for a beverage container shown in FIG. 1.

FIG. 5 shows a top view of the substantially planar platform 202, constituent member of the beverage container support stand 200. As shown in FIG. 5, the substantially planar platform 202 is formed from parallel rigid support wires 230, 232, 234 and 236. The support wires 230 and 232 are formed with open, U-shaped loops which are attached to the horizontal support members 227 and 228 to form closed platform locking loops into which interengaging and interlocking orthogonal leg locking loops formed of the wire legs 204, 206 can be inserted in such a fashion so as to lock the legs 204 and 206 into upright positions thereby maintaining the support platform 202 substantially parallel with the surface on which the legs are resting and by which a container can be supported.

Figure 6:
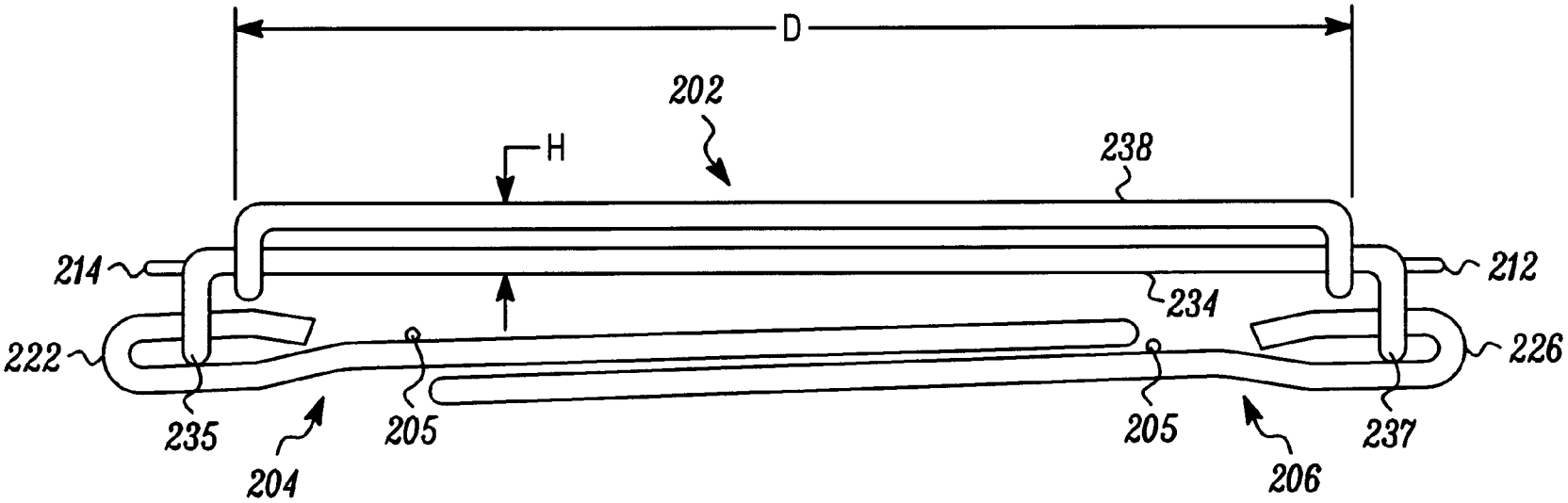
FIG. 6 depicts the support stand of FIG. 1 with the locking loops disengaged from each other and with the legs folded under the platform portion.

FIG. 6 shows the legs 204 and 206 disengaged from the platform locking loops and rotated into compact form, i.e.

folded platform. When the stand 200 is not being used, it can be more conveniently stored and cleaned by disengaging (i.e. removing) the locking loops from each other and nesting the legs 204 and 206 together. Inasmuch as the leg and platform locking loops can be disengaged from each other, the legs are therefore considered to be removable with respect to the platform 202.

As mentioned above, the support legs 204 and 206 can be removed from the platform interlocking loops 212, 214 and 216, 218, and rotated about the horizontal support member 235 and 237. In FIG. 5, the two legs 204 and 206 are shown retracted from the platform locking loops at the opposite ends of the support platform 202, rotated about the horizontal support members 235 and 237 and nested together against the horizontal support platform 202. In such as disassembled state, the support platform for a beverage container provides a compact stand or storage which can be readily reassembled simply by rotating leg 204 about the horizontal member 235, and thereafter reinserting the supporting leg locking loops 220, 222 into the platform locking loops 212 and 214. Similarly, leg 206 can be reassembled by rotating it around the support member 237 and upwardly extending the leg locking loops 224 and 226 through inter-engaging counterparts 218 and 216.

From the foregoing it should be apparent that an easily assembled, easily stored portable, rigid and lightweight support stand and platform for a beverage container such as a wine box or other boxed packaging is provided by rigid wire support members formed as described above.

What is claimed is:

1. A stand for a beverage container and other objects comprising:

a platform having a plurality of platform locking loops;

a first leg mechanism having leg locking loops substantially orthogonal to, and removably inter-engaged with corresponding platform locking loops;

a second leg mechanism having leg locking loops substantially orthogonal to, and removably inter-engaged with corresponding platform locking loops;

whereby said first and second legs are maintained substantially upright and maintained substantially orthogonal to said platform by the removable inter-engagement of said leg and platform locking loops.

2. The stand of claim 1 wherein said platform and said platform locking loops are comprised of wire.

3. The stand of claim 1 wherein said first leg mechanism and said second leg mechanism and said leg locking loops of said first and second legs are comprised of wire.

4. A support stand for a beverage container and other objects comprising:

a substantially rectangular, substantially planar platform, said platform having a width W and a depth D, said platform being formed to have first and second opposing upturned sides of height H, said first and second sides being separated from each other by a distance equal to said width W, said platform further having first and second ends each of which is adjacent both said first and second sides, said first and second ends being separated from each other by a distance equal to said depth D, said first and second ends each having first and second platform locking loops;

a first formed-wire leg having first and second formed-wire leg locking loops for inter-engaging with said first and second platform locking loops of said first end of said platform such that, said first and second formed wire leg locking loops of said first leg are capable of inter-engaging and thereby locking with the first and second platform locking loops at said first end of said platform, said first leg supporting said platform at said first end;

a second formed-wire leg having first and second formed-wire leg locking loops for substantially orthogonally mating and inter-engaging with said first and second platform locking loops of said second end of said platform, such that, said first and second formed wire leg locking loops of said second leg are capable of inter-engaging and locking with said first and second platform locking loops at said second end of said platform, said second leg supporting said platform at said second end; wherein said first and second legs are maintained upright relative to the platform by said first and second platform locking loops of said first and second ends of said platform.

5. The support stand of claim 4 wherein said platform and said platform locking loops are comprised of wire.

6. A foldable support stand for a beverage container and other objects comprising:

a substantially rectangular, substantially planar support platform having first and second ends and formed from at least first and second substantially parallel wires, spaced apart from each other, each of said first and second wires being continuously formed at its first end to have a platform locking loop, each of said first and second wires being continuously formed at its second end to have a platform locking loop;

a first wire leg having first and second formed-wire leg locking loops capable of mating with and substantially orthogonally inter-engaging and locking said first wire leg to said first and second formed-wire platform locking loops at said first end of said-platform, by at least one of: a) the insertion of the locking loops of said first wire leg into locking loops at the first end of said platform; and b) the insertion of said locking loops of the first end of said platform into the locking loops of said first wire leg; thereby providing a first foldable support of said platform by said first wire leg;

a second wire leg having first and second formed-wire leg locking loops capable of mating with and substantially orthogonally inter-engaging and locking said second wire leg to said first and second formed-wire platform locking loops at said second end of said platform, by at least one of: a) the insertion of the locking loops of said second wire leg into locking loops at the second end of said platform; and b) the insertion of said locking loops of the second end of said platform into the locking loops of said second wire leg thereby providing a second foldable support of said platform by said second leg.

7. A foldable support stand for a beverage container and other objects comprising:

a substantially planar support platform formed from first and second parallel, substantially rigid platform wires, spaced apart from each other, each of said first and second rigid platform wires having a first end that is partially wound to form on each wire's first end, a first end open locking loop, each of said platform wires having a second end that is partially wound to form on each wire's second end, a second end open locking loop;

a first length of cross member wire, substantially orthogonal to and attached to said first end open locking loops thereby forming closed platform locking loops at said first ends of said first and second wires;

a second length of cross member wire, substantially orthogonal to and attached to said second end open locking loops thereby forming closed platform locking loops at said second ends of said first and second wires;

a first substantially trapezoidal-shaped wire leg having first and second formed-wire leg locking loops capable of locking the first substantially trapezoidal-shaped wire leg to the planar support platform by the inter-engagement of the first and second formed-wire leg locking loops of said first wire leg with the closed platform locking loops at said first ends of said first and second wires;

a second substantially trapezoidal-shaped wire leg having first and second formed-wire leg locking loops capable of locking the second substantially trapezoidal-shaped wire leg to the planar support platform by the inter-engagement of the first and second formed-wire leg locking loops of said second wire leg with the substantially orthogonally inter-engaging said closed platform locking loops at said second ends of said first and second wires.

8. A support stand for a beverage container and other objects comprising:

a substantially planar platform having a plurality of platform locking loops lying in a plane substantially coplanar to said platform and coupled to said platform;

a first leg mechanism having leg locking loops substantially orthogonal to, and removably inter-engaged with corresponding platform locking loops coupled to said platform;

a second leg mechanism having leg locking loops substantially orthogonal to, and removably inter-engaged with corresponding platform locking loops coupled to said platform;

whereby said first and second legs are maintained substantially upright and maintained substantially orthogonal to said platform by the removable inter-engagement of said leg and platform locking loops.

9. A foldable support stand for a beverage container and other objects comprising:

a substantially rectangular, substantially planar platform, said platform having a width W and a depth D, said platform being formed to have first and second substantially opposing upturned sides of height H, said first and second sides being separated from each other by a distance substantially equal to said width W, said platform further having first and second ends each of which is adjacent both said first and second sides, said first and second ends being separated from each other by a distance substantially equal to said depth D, said first and second ends each having first and second formed-wire platform locking loops substantially coplanar with said platform;

a first formed-wire leg having first and second formed-wire leg locking loops capable of substantially orthogonally mating, and inter-engaging and locking said first formed wire leg to said substantially planar platform by the inter-engagement of said first and second formed-wire platform locking loops of said first end of said platform to the first and second formed-wire leg locking loops of said first leg;

a second formed-wire leg having first and second formed-wire leg locking loops capable of substantially orthogonally mating and inter-engaging and locking said second formed-wire leg to said substantially planar platform by the inter-engagement of said first and second formed-wire platform locking loops of said second end of said platform to the first and second formed-wire leg locking loops of said second leg; wherein said first and second legs are maintained upright relative to the platform by said first and second platform locking loops of said first and second ends of said platform.

10. A support stand for a beverage container and other objects comprising:

a substantially rectangular, substantially planar support platform formed from at least first and second substantially parallel wires, spaced apart from each other, each of said first and second wires having a first end at each of which is located a wire platform locking loop continuously formed therewith each of said first and second wires having a second end at each of which is located a wire platform locking loop continuously formed therewith;

a first wire leg having first and second formed-wire leg locking loops capable of mating with and substantially orthogonally inter-engaging and locking with said first and second formed-wire platform locking loops of said first end of said platform, said first leg supporting said platform at said first end;

a second wire leg having first and second formed-wire leg locking loops mating with and substantially orthogonally inter-engaging and locking with said first and second formed-wire platform locking loops of said second end of said platform, said second leg supporting said platform at said second end.

* * * * *